US006762541B1

(12) United States Patent
Yamamoto et al.

(10) Patent No.: US 6,762,541 B1
(45) Date of Patent: Jul. 13, 2004

(54) ELECTRON-EMITTING DEVICE AND PRODUCTION PROCESS THEREOF

(75) Inventors: Masahiko Yamamoto, Kanagawa-ken (JP); Asai Hironori, Kanagawa-ken (JP); Kouhei Nakayama, Kanagawa-ken (JP); Koji Suzuki, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/567,522

(22) Filed: May 10, 2000

(30) Foreign Application Priority Data

May 14, 1999 (JP) ..... P11-134972

(51) Int. Cl.[7] ..... H01J 1/62
(52) U.S. Cl. ..... 313/306; 313/310
(58) Field of Search ..... 313/306, 309, 313/336, 351, 310, 495; 445/24, 25, 50, 51

(56) References Cited

U.S. PATENT DOCUMENTS 5,866,988 A * 2/1999 Oda ..... 313/495
6,522,061 B1 * 2/2003 Lockwood ..... 313/495

FOREIGN PATENT DOCUMENTS

| | | |
|---|---|---|
| JP | 46-20944 | 6/1971 |
| JP | 64-33833 | 2/1989 |
| JP | 6-231674 | 8/1994 |
| JP | 9-82214 | 3/1997 |
| JP | 2646235 | 5/1997 |
| JP | 9-265899 | 10/1997 |
| JP | 10-55751 | 2/1998 |

OTHER PUBLICATIONS

A. Asai et al, Multiple–Scattering Model of Surface–Conduction Electron Emitters, SID 97 Digest, pp. 127–130, no month.

Y. Gotoh et al, Fabrication of lateral–type thin–film edge field emitters by focused ion beam technique., J. Vac. Sci. Technol. B 13(2), Mar./Apr. 1985, pp. 465–468, no month.

* cited by examiner

*Primary Examiner*—Vip Patel
*Assistant Examiner*—Joseph Williams
(74) *Attorney, Agent, or Firm*—Oblon, Spivak, McClelland, Maier & Neustadt, P.C.

(57) ABSTRACT

A horizontal type electron-emitting device structure and process of making, wherein the device includes a low-potential electrode and a high-potential electrode which are formed on a substrate, and an electron-emitting part placed between the electrodes. Above the substrate is an anode. A secondary-electron emitting material is arranged on the top of a region from the electron-emitting part to the high-potential electrode, so that secondary electrons are efficiently emitted to the anode, thereby to contribute to efficient electron emission. An auxiliary electrode may be formed, with a high-resistance or insulating layer interposed, on the substrate in the vicinity of the high-potential electrode. A voltage higher than that of the high-potential electrode is then applied to the auxiliary electrode, so that electrons emitted from the electron-emitting part are attracted to the auxiliary electrode.

17 Claims, 10 Drawing Sheets

ELECTRON-EMITTING DEVICE AND PRODUCTION PROCESS THEREOF

CROSS REFERENCE TO RELATED APPLICATIONS

This application claims benefit of priority under 35 U.S.C. 120 to Japanese Patent Application No. P11-134972 filed in the Japanese Patent Office on May 14, 1999, the entire contents of which are incorporated by reference herein.

BACKGROUND OF THE INVENTION

1. Field of the Invention

The present invention relates to an electron-emitting device to be applied to images units and electron beam exposure systems. The present invention relates also to a process for producing the same.

2. Description of the Related Art

Application of a high electric field (on the order of $10^7$ V/cm) to the surface of a metal or a semiconductor causes electrons to be emitted into a vacuum through tunneling to the vacuum level. Electron emission of this kind is generally called field emission.

A field emission type cold cathode offers the advantage of emitting a larger number of electrons per unit area than emitted by a hot cathode. In other words, electron emission from cold cathodes can be as large as is $10^7$ to $10^9$ amperes per $cm^2$, whereas that from a hot cathode is limited to tens of amperes per $cm^2$. Therefore, a field emission type cold cathode is particularly useful for the miniaturization of vacuum electron devices.

An actual example of a miniaturized vacuum device, or vacuum microelectronic device, that employs a cold cathode was reported by Shoulders (Adv. Comput. 2 (1961) 135.) This publication discloses a process for producing a device of the size of 0.1 micron, and also covers a process for producing a minute diode of a field emission type by using the disclosed device.

Spindt et al (J. Appl. Phys. 39 (1968) 3504.) reported a process for producing by thin-film technology a large number of gated cold cathodes., or triodes, of micron size arranged in an array structure on a substrate. Since then, many reports have appeared in this field.

The cold cathode proposed by Spindt et al is designed such that an electric field is concentrated at the sharp tip of a minute pyramidal emitter of micron size, and the field emission of electrons is controlled by a gate electrode located nearby the tip.

The Spindt-type device is provided with a gate having an opening right above the emitter and an anode placed above the emitter. The number of electrons emitted toward this anode can be controlled by the gate-emitter voltage.

Many other electron emitting devices of similar structure have been reported. They are produced by etching of silicon or by molding and are of a "vertical structure," in which the emitter and gate are arranged vertically with respect to the substrate.

By contrast, those of a so-called "horizontal structure" are also reported. These have a pair of electrodes arranged on a substrate, one functioning as the emitter and the other functioning as the gate.

The horizontal type device is inferior to that of a vertical type in electron emitting efficiency. However, the former offers the advantage of being produced easily especially in the case where a number of elements are arranged in a large area.

Incidentally, electron emitting efficiency is defined as the ratio of current reaching the anode to current flowing through all the elements. In other words, it is the quotient obtained by dividing the number of electrons leaving the emitter and reaching the anode by the total number of electrons entering the emitter. Electrons emitted by the emitter partly reach the anode, and partly are absorbed by the gate. The greater the value of electron emitting efficiency, the larger the number of electrons reaching the anode or the larger the amount of current.

One example of the horizontal type device shown in FIG. 8, reported in J. Vac. Sci. Technol. B13 (1995) 465, consists of a silicon substrate 701, an insulating layer 702 of $SiO_2$, and an H-shaped metal thin film 703, arranged sequentially on top of each other. The metal thin film has a minute narrow gap 705 (about 2 $\mu$m wide) formed by a focused ion beam 704. Thus, a pair of electrodes (an emitter 706 and a gate 707) is formed, with the minute narrow gate gap 705 interposed between them. An anode is placed above the paired electrodes a certain distance away from and parallel to the silicon substrate 701. Electrons are emitted by applying a potential difference across the emitter 706 and the gate 707, and partly recovered at the anode.

One effective way to reduce the voltage for electron emission in the horizontal type device is to sharpen the tip of the electrode, or to narrow the gap between the electrodes down to a sub-micron level (below a micron) between the electrodes.

Many other devices having similar configurations have also been fabricated by a process called "electroforming." In this process, an electric current is passed through the film, and the film suffers Joule heating which forms cracks that separate electrodes in the film. The electron-emitting device of this kind is sometimes called a "surface conduction type electron-emitting device."

An example of such device is disclosed by M. I. Elinson, Radio Eng. Electron Phys., 10. 1290 (1965). The advantage of this device is the ease with which it can be produced. Elinson's devices in which the film is formed by vacuum deposition, however, suffers the disadvantage of being unstable in action and short in life. This disadvantage was overcome by the device shown in FIG. 9, which is disclosed in Japanese Patent No. 2-646235. This device, formed from a fine particle film, is greatly improved in reliability. It has electrodes 1101 and 1102 on a substrate and it also has a fine particle thin film between these electrodes 1101 and 1102. A minute gap 1105 is formed by the electroforming. This minute gap 1105 separates the emitter 1103 and the gate 1104 from each other. Fine particles 1106 are partly exposed on the edges of the minute gap 1105.

The horizontal type device as mentioned above is inferior to that of a vertical type in electron emitting efficiency. One reason for this is reported by A. Asai, SID 97 DIGEST, 127. The device described proposed by Asai et al. is shown in FIG. 10. It has wiring 12204 formed on a substrate. The wiring is covered with a thin film, which has a minute gap 12201 formed at the center thereof. The emitter 12202 and the control electrode 12203 are formed, having this minute gap 12201 interposed between them. The anode 12206 is placed a certain distance away and above the emitter 11202 and the control electrode 12203.

As the emitter 12202 emits electrons into a vacuum, the emitted electrons fly mostly toward the control electrode 12203 and partly toward the anode 12206. Most of the emitted electrons reach the control electrode 12203. Electrons are partly disturbed by the control electrode 12203, and are caused to move toward the anode 12206. Almost all of the electrons are recovered at the control electrode 12203. On the upper side of the control electrode near the emitter is a region in which there exists an upward electric field. Electrons which enter this region are accelerated toward the control electrode. The problem with this is that most of the emitted electrons do not reach the anode 12206. In addition, the flow of electrons from the emitter 12202 to the control electrode 12203 causes heat generation, and wastes electric power.

One known way to improve the device efficiency is to increase the number of electrons scattered or reflected by the control electrode. For example, Japanese Patent Laid-open No. 265899/1998 discloses a control electrode which is provided with an easily oxidizable material to increase the reflection of electrons.

Also, Japanese Laid-Open Patent No. 231674/1994 discloses a control electrode which is provided with electrically conductive ultra fine particles having a radius equal to the mean free path of electrons. The film of ultra fine particles readily changes the direction of the electrons colliding with it. The result is a reduction in number of electrons captured by the control electrode.

Another method of increasing the emission efficiency is disclosed in Japanese Patent Laid-open No. 8221/1998. This method consists of correcting the electric field on the control electrode, thereby decreasing the number of electrons falling on the control electrode. The object is achieved by providing a third electrode next to the emitter or control electrode so as to control the electric field on the control electrode. The disadvantage of this method is that electrons fall on the correction electrode if the correction electrode for correcting the electric field is not provided adequately, with the result that efficiency is not improved. Therefore, placement of the correction electrode is restricted. Moreover, for a sufficient improvement in efficiency, it is necessary to place the correction electrode near the point of electron emission and to apply the an voltage in excess of about 100 V. This leads to device instability.

As mentioned above, the electron emission horizontal type device is simpler in structure than that of a vertical type, and hence it is easier to produce. On the other hand, it has a low electron emission efficiency. Various attempts have been made to improve the electron emission efficiency of the horizontal type device, e.g., by increasing the scattering or reflection of electrons on the surface of the control electrode or by correcting the distribution of the electric field. Nevertheless, further improvement from the standpoint of better efficiency and device stability is desired.

SUMMARY OF THE INVENTION

Accordingly, the present invention provides a horizontal type electron emission device including a control electrode and a third secondary-electron emitting material. The control electrode supplies a sufficient amount of scattered electrons, and causes electrons to collide with the third secondary-electron emitting material, thereby improving electron emission efficiency.

Therefore, according to the present invention, it is desirable that the electrons are efficiently scattered by the surface of the control electrode, and that electrons are emitted toward the anode. To that end, the secondary-electron emission takes place efficiently on the surface of the control electrode.

Thus, the present invention is directed to a horizontal type electron-emitting device including a low-potential electrode and a high-potential electrode formed separately on a substrate and on an electron emitting part formed between said electrodes. A secondary-electron emitting material, capable of emitting secondary electrons more efficiently than the material of the high-potential electrode, is exposed on a part of the substrate in the region from the electron-emitting part to the high-potential electrode.

Owing to the secondary-electron emitting material which is exposed in the vicinity of the electron-emitting part and the high-potential electrode, the device of the present invention efficiently emits secondary electrons upon collision of electrons emitted from the electron emitting part.

The present invention is also directed to a horizontal type electron emitting device, which further includes an auxiliary electrode formed near the high-potential electrode on the substrate, with an insulating layer or high-resistance layer interposed between these electrodes. The voltage applied to the auxiliary electrode is higher than that applied to the high-potential electrode. This structure causes electrons emitted from the electron emitting part to collide with the auxiliary electrode, so that secondary electrons are emitted efficiently from the auxiliary electrode.

According to the present invention, a secondary-electron emitting material is exposed on the upper surface of the auxiliary electrode, and a properly controlled voltage is applied to the high-potential electrode and the auxiliary electrode. This causes electrons emitted from the electron emitting part to collide with the auxiliary electrode, so that it is possible to double multiply the number of electrons for emitting secondary electrons from the auxiliary electrode.

The secondary-electron emitting material includes at least one of LiF, CaF, AlN, BN, B, Bi, Ga, BaO, and MgO.

According to the present invention, the high-potential electrode and its vicinity are covered with a film containing the above-mentioned secondary-electron emitting material. This causes secondary electrons to be emitted efficiently no matter where electron collision takes place.

According to the present invention, a secondary-electron emitting material in the form of fine particles is exposed in at least one part of the region from the electron emitting part to the high-potential electrode. This improves the efficiency of secondary-electron emission.

The present invention is also directed to a process for producing an electron emitting device, including forming a low-potential electrode, a high-potential electrode, and an electron emitting part separately on a substrate, and applying a voltage across the high-potential electrode and the low-potential electrode in a gas containing a boron compound, so that electrons are emitted from the electron emitting part, decompose the gas, and form a BN film on the upper surface of the electron emitting part and its vicinity.

The BN film formed in the vicinity of the electron emitting part improves the efficiency of electron emission from the electron emitting part. The boron compound from which the BN film is formed includes, for example, boranes, amineboranes, aminoboranes, pyridineboranes, piperazineboranes, alkylboranes, boric acid esters (such as alkoxyboranes and arylborane), and cyclic compounds (such as borazine) having B—N bonds.

The electron-emitting part may be formed from a material containing boron. In this case, the process starts with forming the low-potential electrode, the high-potential electrode, and the electron-emitting part on the substrate. Then, heat treatment is carried out in a nitrogen or a nitrogen-containing atmosphere, so as to form a BN film on the upper surface of the electron-emitting part and its vicinity.

With such simple treatment, it is possible to form a BN film in the periphery of the electron-emitting part.

The present invention further provides a field emission element including a substrate; a first electrode on the substrate; a second electrode separated from the first electrode on the substrate; a coating layer having a smooth surface provided on the second electrode, wherein the coating layer is formed by a secondary-electron emitting material.

An accelerating energy of an electron formed by an electric potential difference between the first electrode and the second electrode may substantially equal to $E_{PE(m)}$.

Still further, the present invention provides a field emission element including a substrate; a first electrode on the substrate; a second electrode separated from the first electrode on the substrate; a third electrode separated from the second electrode on the substrate, and the second electrode being put between the first electrode and the third electrode; and a first secondary-electron emitting material on the second electrode.

The first electrode and the second electrode may engage each other.

The first secondary-electron emitting material can coat the second electrode smoothly.

The first secondary-electron emitting material may be particles.

An accelerating energy of an electron formed by an electric potential difference between the first electrode and the second electrode may be between $E_{PE(I)}$ and $E_{PE(II)}$. An accelerating energy of an electron formed by an electric potential difference between the first electrode and the second electrode may substantially equal to $E_{PE(m)}$.

The field emission element may further include a second secondary-electron emitting material on the third electrode.

The second secondary-electron emitting material may coat the third electrode smoothly. The second secondary-electron emitting material may be particles.

A maximum of a secondary electron increasing ratio of the first secondary-electron emitting material may be smaller than a maximum of a secondary electron increasing ratio of the second secondary-electron emitting material. An $E_{PE(I)}$ of the first secondary-electron emitting material may be smaller than an $E_{PE(I)}$ of the second secondary-electron emitting material. An accelerating energy of an electron formed by an electric potential difference between the second electrode and the third electrode may be between $E_{PE(I)}$ and $E_{PE(II)}$. An accelerating energy of an electron formed by an electric potential difference between the second electrode and the third electrode substantially equals to $E_{PE(m)}$.

The field emission element may further include an insulator between the first electrode and the second electrode.

The field emission element may further include an insulator between the second electrode and the third electrode.

The field emission element may further include a third secondary-electron emitting material on the insulator.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE PREFERRED EMBODIMENTS

Figure 1:
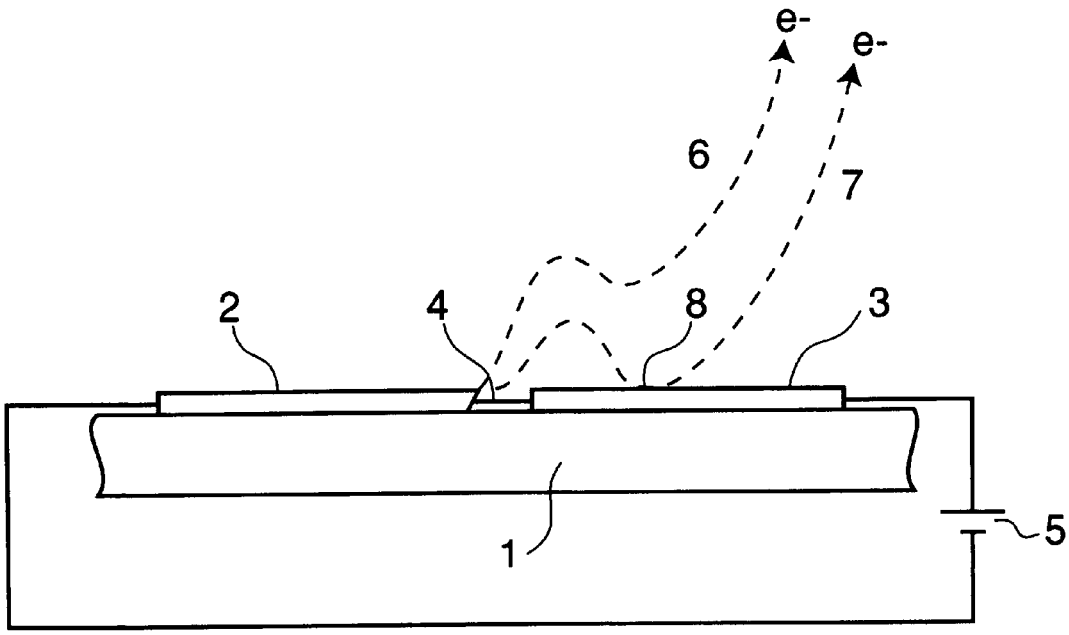
FIG. 1 is a schematic diagram showing the structure of the electron-emitting element according to a first embodiment of the present invention.

Referring now to the drawings, wherein like reference numerals designate identical or corresponding parts throughout the several view, and more particularly to FIG. 1 thereof, there is schematically shown a first embodiment of a horizontal type electron emitting device according to the present invention. The device of FIG. 1 includes a substrate 1, a thin film functioning as a low-potential electrode (emitter) 2, a thin film functioning as a high-potential electrode (gate) 3, a high-resistance part or an insulating part 4 separating the electrodes, a voltage source 5 for applying a voltage across the low-potential electrode 2 and the high-potential electrode 3, a trajectory 6 of an emitted electron which does not collide with the high-potential electrode 3, a trajectory 7 of an emitted electron which collides with the high-potential electrode 3, and a position 8 where an emitted electron collides with the high-potential electrode. Above the substrate 1 is an anode (not shown), which has a higher potential relative to both the low-potential electrode 2 and the high-potential electrode 3.

The substrate 1 may be quartz glass, Pyrex glass, a blue glass plate, a stainless steel plate coated with an insulating film of $SiO_2$, an aluminum plate coated with an anodized film of a barrier type, or a silicon wafer. The selection of these materials depends on the intended use of the electron-emitting device and the production cost. For use as a display unit, it is desirable to select a material that has low degree of deformation and also has a coefficient of thermal expansion similar to that of the entire display panel.

The low-potential electrode 2 and the high-potential electrode 3 may be formed from any common conducting material, preferably one with a low resistance, a high thermal conductivity, and a high melting point. Typical examples include Ni, Cr, Cu, Au, Pt, Ir, Pd, Ti, Al, Mo, and W, and alloys thereof. The low-potential electrode 2 and the high-potential electrode 3 may have a film thickness of 10 nm to 1 micron.

The low-potential electrode 2 and the high-potential electrode 3 may be formed by sputtering, vacuum evaporation deposition, printing, or plating. To ensure good adhesion to the substrate 1, it is desirable to form a very thin adhesive layer of metal such as Cr. The adhesive layer may be replaced by a surface treatment of the substrate 1. such as by annealing in a hydrogen atmosphere.

Alternatively, the low-potential electrode 2 and the high-potential electrode 3 may be formed from different materials. The high-resistance or insulating electrode separating part 4 between the low-potential electrode 2 and the high-potential electrode 3 may be formed by removing the electrode thin film completely so that the insulating substrate 1 is exposed, or by partly removing the electrode thin film. An alternative way is to partly oxidize the electrode thin film, thereby making it highly resistant.

The distance between the low-potential electrode 2 and the high-potential electrode 3 may be about 1 nm to about 10 $\mu$m. The desirable distance depends on the condition of the high-resistance or insulating electrode separating part 4.

After the device has been completed as described above, a voltage is applied from the voltage source 5 across the low-potential electrode 2 and the high-potential electrode 3. This voltage application causes electrons to be emitted from the vicinity of the boundary between the low-potential electrode 2 and the electrode separating part 4.

Figure 2:
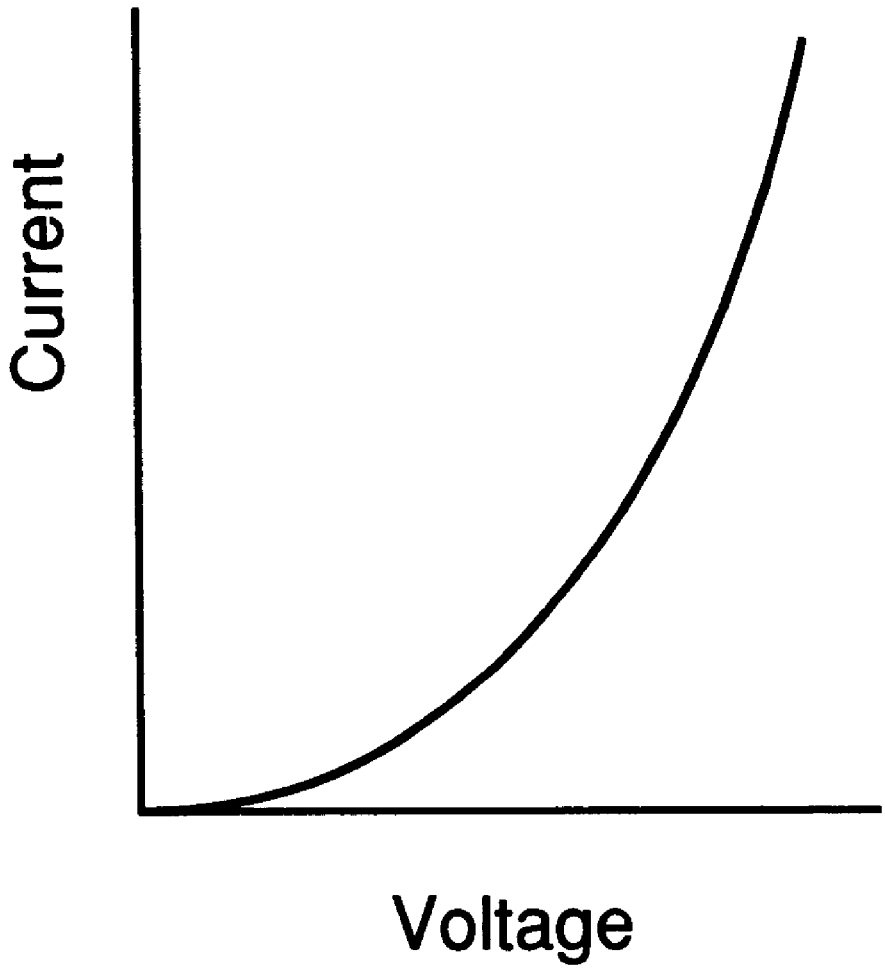
FIG. 2 is a diagram showing the I–V characteristics of the first embodiment of the present invention.

The I–V characteristic representing the relation between the current of emitted electrons and the voltage applied is non-linear as shown in FIG. 2. For stable electron emission, it is desirable that the container in which the electron-emitting device is installed be sufficiently evacuated. For example, the pressure in the container should be lower than $10^{-5}$ Torr, preferably $10^{-7}$ Torr. Such a low pressure is necessary for eliminating the effect of molecules adsorbed on the surface of the electrode, to prevent gas in the container from being ionized by electron collision, to prevent damage of reverse sputtering by ionized molecules, and to prevent the occurrence of ion current (electric discharge).

Figure 3:
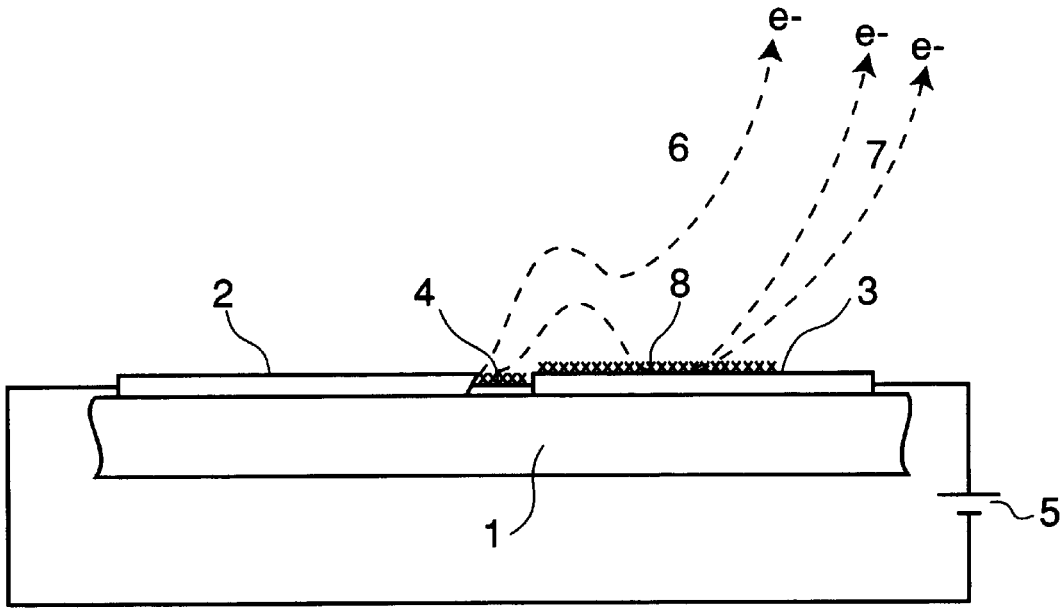
FIG. 3 is a diagram showing the distribution of the secondary-electron emitting material.

Some of the emitted electrons follow the trajectory 6, which does not come into contact with the high-potential electrode 3, as shown in FIG. 1. However, most of them follow the trajectory 7, which comes into contact with the high-potential electrode 3, as shown in FIG. 3. The electrons are partly captured by the high-potential electrode 3 at the point of contact 8, and the electrons are partly reemitted by elastic scattering. Some electrons undergo inelastic scattering. Those electrons that have undergone elastic scattering fly to the anode along the trajectory 7. Those electrons which have undergone inelastic scattering excite the electrons on the surface of the high-potential electrode 3, thereby bringing about the secondary-electron emission. These secondary electrons fly along the trajectory 7 to reach the anode.

The electron-emitting device according to the first embodiment is shown in FIG. 3. It is characterized in that the upper surface of the secondary-electron emitting region (from the electron emitting part to the high-potential electrode 3) is provided with a secondary-electron emitting material capable of emitting secondary electrons more efficiently than the material of the high-potential electrode 3. In FIG. 3, the area that has the secondary-electron emitting material is indicated by the letter "x".

The secondary-electron emitting material that is exposed on the upper surface permits secondary electrons to be emitted efficiently toward the anode. The result is that the number of electrons captured by the high-potential electrode 3 is reduced, and the efficiency of electron emission is increased.

The secondary-electron emitting material may be formed from any of LiF, CaF, AlN, BN, B, Bi, Ga, BaO, and MgO, with BN being preferable. This material may be in the form of a film on the secondary-electron emitting region; it may also be in the form of fine particles exposed on the upper surface of the substrate. When the secondary-electron emitting material forms a film, the surface of the film on the electrode can be smooth. The smooth surface makes coherent trajectories of the electrons without diffused reflections. When the diffused reflections occur, many of the reflected electrons fall on the film again, with some of them being re-captured by the film; smoother surfaces are preferred in order to enhance the net efficiency of the electron reflection.

Figure 4:
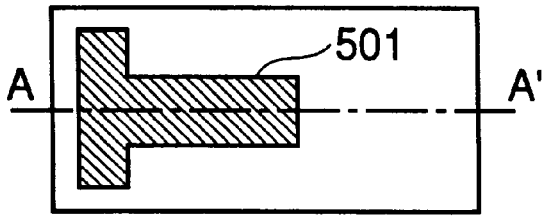
FIGS. 4(*a*)–4(*g*) are plan views showing the steps of producing the electron-emitting device according to the first embodiment of the present invention.
Figure 4:
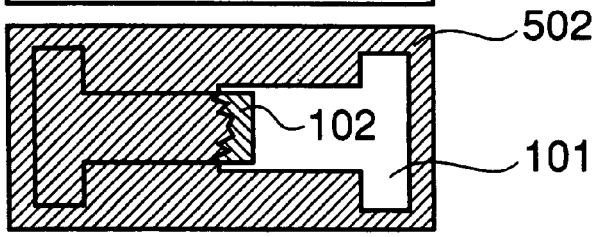
Figure 4:
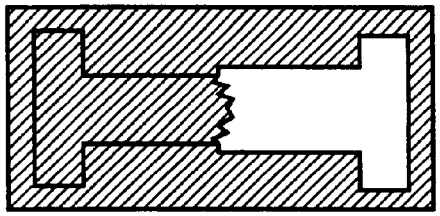
Figure 4:
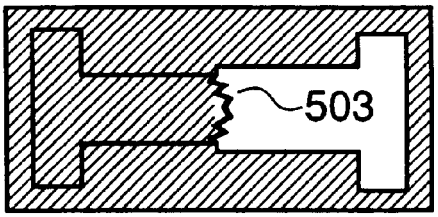
Figure 4:
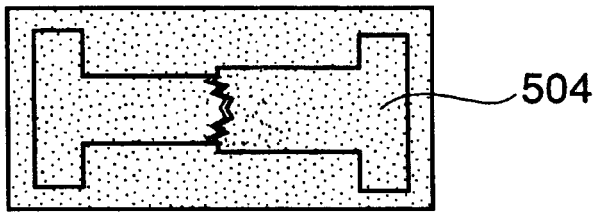
Figure 4:
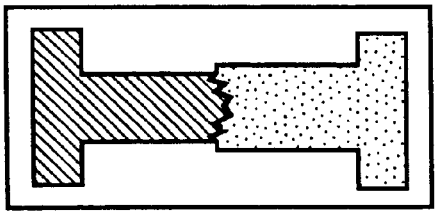
Figure 4:
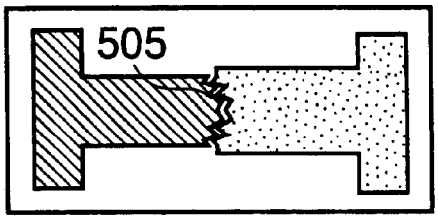
Figure 5:
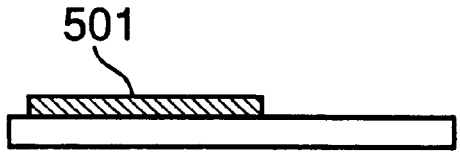
FIGS. 5(*a*)–5(*g*) are sectional views showing the steps of producing the electron-emitting device according to the first embodiment of the present invention.
Figure 5:
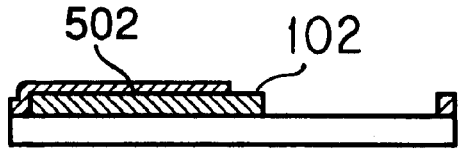
Figure 5:
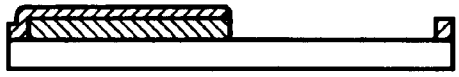
Figure 5:
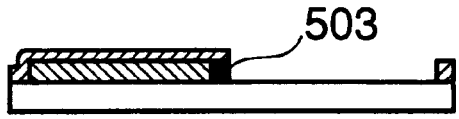
Figure 5:
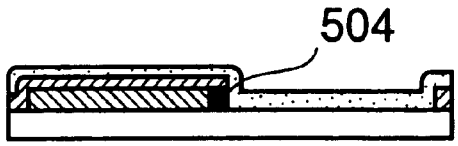
Figure 5:
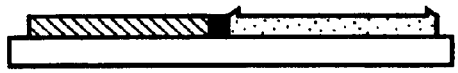
Figure 5:
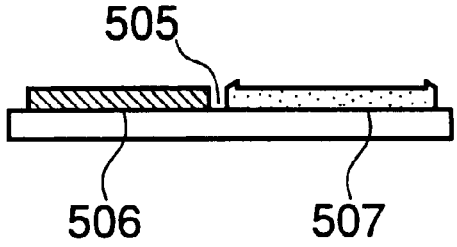

FIGS. 4(*a*)–4(*g*) are plan views showing the process of producing the electron-emitting device according to the first embodiment of the present invention. FIGS. 5(*a*)–5(*g*) are sectional views taken along the line A–A' in FIG. 4(*a*). The steps of the process will be described with reference to FIGS. 4(*a*)–4(*g*) and 5(*a*)–5(*g*).

First, the insulating substrate 1 undergoes Ti deposition process,(by sputtering, for example) and patterning, so that the electrode thin film 501 is formed as shown in FIGS. 4(*a*) and 5(*a*). The film thickness is about 100 nm and the width (W) is about 50 $\mu$m.

A resist coating 502 (OFPR800, 100CP from Tokyo Ohka) is coated, and an opening 101 is made in this resist coating 502 such that the electrode film 501 which has been patterned in the step of FIG. 4(*a*), is partly exposed, as shown in FIGS. 4(*b*) and 5(*b*). Patterning should be carried out to sharpen the end 102 of the electron emitting part to be formed later. In other words, the part overlapping with the electrode film 501 may be straight or zigzag. The sharp end promotes the concentration of the electric field, and improves the amount of electron emission.

The electrode thin film 501 exposed in the opening 101 is removed by RIE (reactive ion etching) with chlorine gas and boron trichloride gas, as shown in FIGS. 4(*c*) and 5(*c*).

Anodic oxidation with ammonium borate and ethylene glycol is carried out to form the $TiO_2$ part 503 near the end of the electrode thin film 501, as shown in FIGS. 4(*d*) and 5(*d*) The $TiO_2$ part 503 may be about 50 nm wide, for example.

The material for the high-potential electrode is deposited on the upper surface of the substrate 1, as shown in FIGS. 4(*e*) and 5(*e*). The Ti thin film 504 about 200 nm thick, for example, is formed by sputtering deposition.

For comparison, two samples are prepared. One has a boron film (about 100 nm thick) deposited on the upper surface of the Ti thin film 504. The other has no boron film.

The resist 502 and the Ti film 504 formed thereon are removed by lift-off, as shown in FIGS. 4(*f*) and 5(*f*. Thus, the low-potential electrode 506 and the high-potential electrode 507 are formed.

The $TiO_2$ part 503 is selectively dissolved for removal with a mixed solution of hydrogen peroxide and sulfuric acid, as shown in FIGS. 4(*g*) and 5(*g*). Thus, the low-potential electrode 506, the crack 505, which functions as the electron emitting part, and the high-potential electrode 507 are completed. When the $TiO_2$ part 503 undergoes etching, the high-potential electrode 501 may also be partly etched. The gap of the crack 505 may be about 65 nm, for example.

After the above-mentioned steps, wiring is made for the low-potential electrode 506 and the high-potential electrode 507. Thus there is obtained the electron-emitting horizontal type device, as shown in FIG. 1.

The secondary-electron emitting material covering the high-potential electrode 3 and the electrode separating part 4 may be formed such that it covers or is dispersed on the surface of the high-potential electrode 3, or such that it forms an overcoating layer. The secondary-electron emitting material may be in the form of fine particles or layers. The layer of the secondary-electron emitting material has a smooth surface for avoiding diffused reflection of electrons.

To evaluate the resulting device, an anode was placed about 5 mm above the substrate 1. With the low-potential electrode 2 kept at 0 V, a voltage of about 20 V was applied to the high-potential electrode 3, and a voltage of about 8 kV was applied to the anode. The efficiency of electron emission was 5% in the device with boron, the secondary-electron emitting material, deposited on the high-potential electrode 3 and the electrode separating part 4. By contrast, the efficiency of electron emission was 1% in the device without any boron deposition.

Electrons that have been emitted from the low-potential electrode 506 are attracted to the high-potential electrode 507. Some of them fly to the anode without reaching the high-potential electrode 507, and the remainder reaches the high-potential electrode 507.

Those electrons reaching the high-potential electrode 507 are partly absorbed by the high-potential electrode 507, partly undergo elastic scattering on the surface of the high-potential electrode 507, and partly undergo inelastic scattering on the surface of the high-potential electrode 507.

Those electrons that undergo elastic scattering on the surface of the high-potential electrode 507 proceed to the anode as though they have rebounded from the surface. Those electrons that undergo inelastic scattering on the surface of the high-potential electrode 507 cause secondary electrons to be emitted from the surface of the high-potential electrode 507, and these secondary electrons proceed to the anode.

According to the first embodiment, a secondary-electron emitting material, boron in this example, is arranged on the upper surface of the secondary-electron emitting region from the electrode separating part 4 to the high-potential electrode 507. The secondary-electron emitting material efficiently emits secondary electrons. Therefore, the device emits a large number of electrons due to inelastic scattering on the surface of the high-potential electrode 507. Thus it is possible to improve the efficiency of electron emission.

The second embodiment is characterized in that an auxiliary electrode is formed near the high-potential electrode 3, with a high-resistance or insulating layer interposed.

Figure 6:
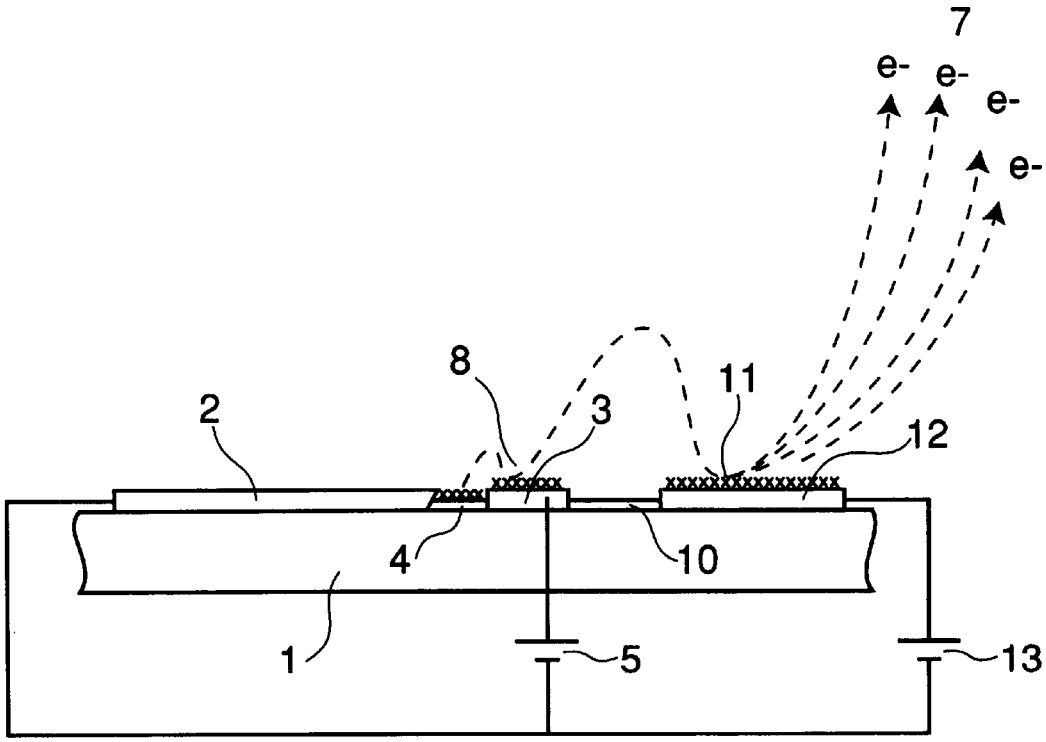
FIG. 6 is a schematic diagram showing the structure of the electron-emitting device according to a second embodiment of the present invention.

FIG. 6 is a schematic diagram showing the structure of the electron-emitting device according to a second embodiment of the present invention. In FIGS. 1 and 6, the same parts are given the same reference numerals. Their differences are explained in the following.

On the substrate 1 is formed an auxiliary electrode 12, which is close to the high-potential electrode 3, with a high-resistance or insulating layer 10 interposed. The reference numeral 11 in FIG. 6 is the position at which those electrons that have been emitted from the electron emitting part collide with the auxiliary electrode 12. In FIG. 6, there is shown a voltage source 13 for applying a voltage across the auxiliary electrode 12 and the low-potential electrode 2.

In FIG. 6, the auxiliary electrode 12 is formed in the same plane as the low-potential electrode 2 and the high-potential electrode 3. The position of the auxiliary electrode 12 is not limited to this. It may be placed above the high-potential electrode 3, or it may be formed with a high-resistance layer or an insulating layer interposed.

A voltage, which is higher than that of the high-potential electrode 3, is applied to the auxiliary electrode 12 from the voltage source 13. The voltage to be applied to the auxiliary electrode 12 depends on the secondary-electron emitting material arranged on the surface of the auxiliary electrode 12.

Figure 7:
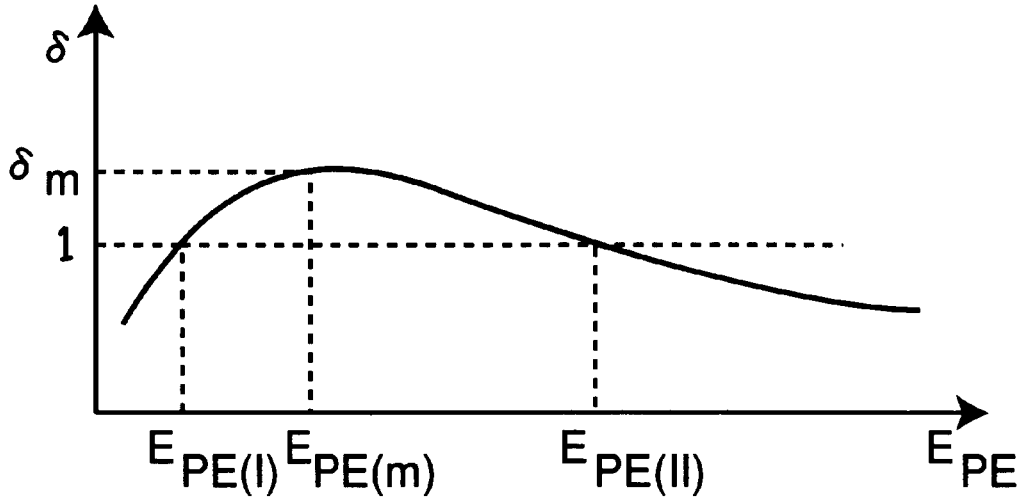
FIG. 7 is a diagram showing the characteristic properties of secondary-electron emission.
Figure 8:
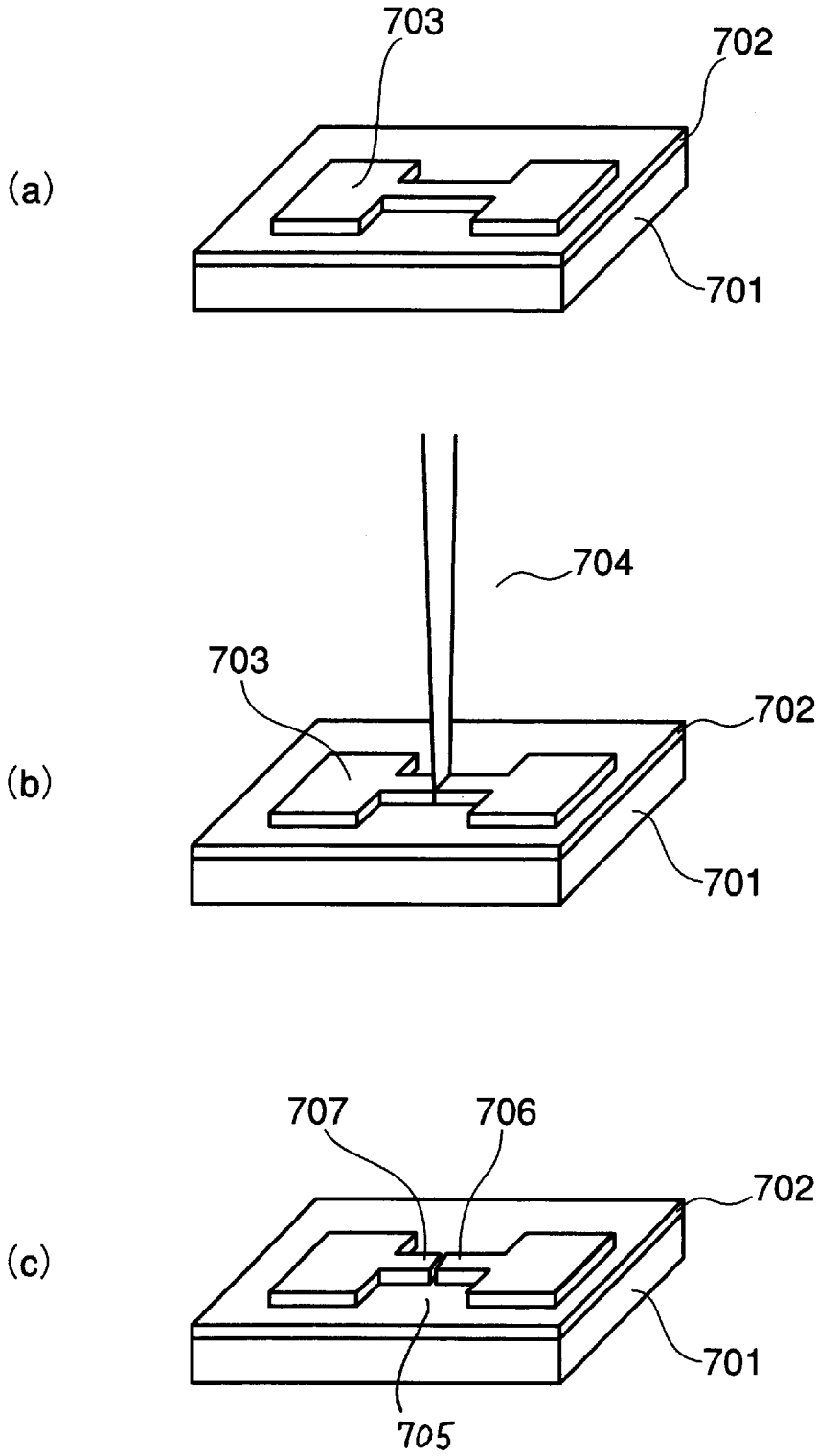
FIG. 8 is a diagram showing the structure of the device reported in J. Vac. Sci. Technol. B13 (1995) 465.
Figure 9:
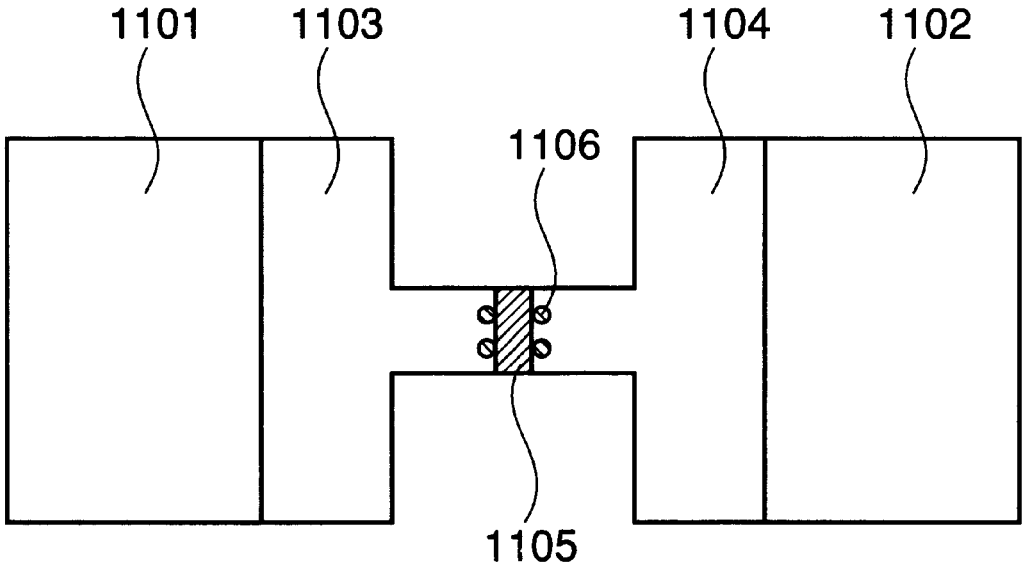
FIG. 9 is a diagram showing the structure of the device disclosed in Japanese Patent No. 2-646235.
Figure 10:
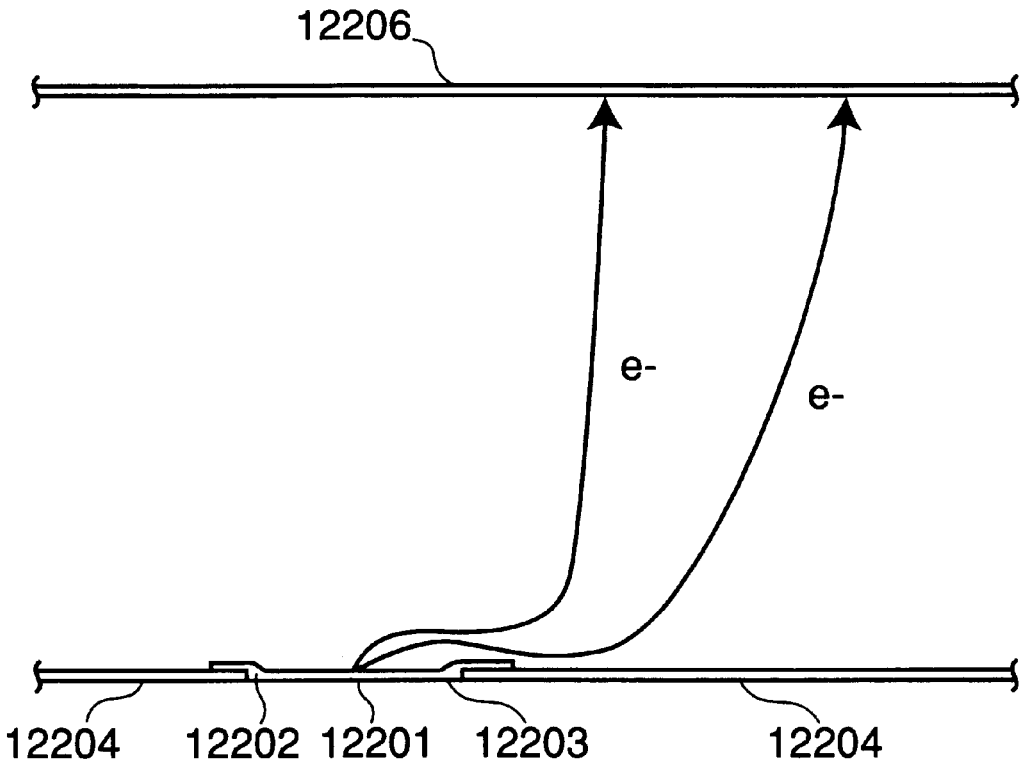
FIG. 10 is a diagram showing the structure of the device reported by A. Asai, SID 97 DIGEST, 127.

FIG. 7 shows the characteristics of secondary-electron emission. The abscissa represents the energy ($E_{PE}$) of primary electrons incident on the surface of the electrode. The ordinate represents the multiplication factor $\delta$ of secondary electrons, which is a quotient obtained by dividing the number of emitted electrons by the number of incident electrons.

It is noted from FIG. 7 that the multiplication factor $\delta$ of secondary electrons depends on $E_{PE}$. In the case where $\delta$ is greater than 1, the number of electrons is increased by the secondary-electron emission. In other words, more secondary electrons than incident primary electrons are emitted.

In FIG. 7, the response to the increasing energy of incident electrons is plotted. $E_{PE(I)}$ represents the energy of incident electrons for which $\delta$ rises to 1 (unity). $E_{PE(m)}$ represents the energy of incident electrons for which $\delta$ is maximum. $E_{PE(II)}$ represents the energy of incident electrons for which $\delta$ falls to unity again. The energy of incident electrons depends uniquely on the secondary-electron emitting material.

When a potential difference $\Delta V$ is applied across the high-potential electrode 3 and the auxiliary electrode 12, electrons are accelerated as much as $e\Delta V$ while they move from the high-potential electrode 3 to the auxiliary electrode 12. Here, e denotes the elementary electric charge. The value of accelerating energy should preferably be between $E_{PE(I)}$ and $E_{PE(II)}$, and more preferably equal to $E_{PE(m)}$. The desirable potential difference depends on the characteristic properties of the secondary-electron emitting material on the surface of the auxiliary electrode and in the vicinity of the auxiliary electrode.

The relationship between the high-potential electrode 3 and the auxiliary electrode 12 is explained above, and that between the low-potential electrode 2 and the high-potential electrode 3 can be explained similarly.

Incidentally, in FIG. 6, the same reference numeral is used for the secondary-electron emitting material on the surface of the high-potential electrode 3 and the secondary-electron emitting material on the surface of the auxiliary electrode 12. However, it is possible to use different materials. For example, a material with a low value of $E_{PE(I)}$ may be used for the high-potential electrode 3, so that a large number of secondary electrons is emitted even though the incident energy is low. The reason for this is that the low-potential electrode 2 and the high-potential electrode are so close to each other that it is difficult to apply via high voltage without causing instabilities, and it is difficult to impart a high accelerating energy to the primary electrons being emitted from the low-potential electrode 2. In addition, it is desirable that the auxiliary electrode 12 should be made of a material that has a large value of the maximum multiplication factor $\delta_m$ of secondary electrons. The reason for this is that it is possible to establish comparatively freely a potential difference between the high-potential electrode 3 and the auxiliary electrode 12.

The auxiliary electrode 12 in this example is formed from platinum by thick printing, and it has BaO fine particles dispersed on its surface. According to this embodiment, the distance between the auxiliary electrode 12 and the high-potential electrode 3 is about 20 $\mu$m.

The electron-emitting device shown in FIG. 6 was found to have an efficiency of electron emission as high as about 10% when measured by setting the low-potential electrode at 0 V, the high-potential electrode at about 20 V, and the auxiliary electrode at about 200 V.

According to the second embodiment mentioned above, the device is characterized in that the auxiliary electrode 12 is formed, with a high-resistance or insulating layer 10 interposed, near the high-potential electrode 3 on the substrate 1, and a voltage higher than that of the high-potential electrode 3 is applied to the auxiliary electrode 12. Therefore, the electrons emitted from the electron emitting part are attracted to the auxiliary electrode 12. In this state, the secondary-electron emitting material dispersed on the surface of the auxiliary electrode 12 increases the efficiency of secondary-electron emission, and hence the efficiency of electron emission can be improved.

The secondary-electron emitting material on the auxiliary electrode 12 may be present in any form; that is, it may be dispersed on the auxiliary electrode 12, or it may cover the surface of the auxiliary electrode 12, or it may form an overcoat layer. The secondary-electron emitting material may be in the form of fine particles or layers.

The third embodiment of the present invention is the electron-emitting device that has an improved efficiency of electron emission.

The electron-emitting part according to the third embodiment of the present invention is produced by the steps explained in the following. First, the same steps as shown in FIGS. 4 and 5 are followed to form the low-potential electrode 2, the high-potential electrode 3, and the electron-emitting part on the substrate 1. Then, a counter substrate having an anode is placed above the electrodes, and both substrates are joined, with a spacer interposed between them.

The substrates are placed in a container having an exhaust pipe and an intake pipe. With the gas pressure properly controlled, a gas containing a boron compound is introduced into the container.

A voltage is applied across the low-potential electrode 2 and the high-potential electrode 3, so that electrons are emitted from the electron-emitting part. Emitted electrons collide with the boron compound in the container. As a result, a BN film is formed in the vicinity of the electron-emitting part.

The BN film improves the efficiency of electron emission from the electron-emitting part. As the result, it is possible to increase the number of secondary electrons proceeding to the anode.

Examples of the boron compound include boranes, amineboranes, aminoboranes, pyridineborane, piperazineborane, alkylboranes, boric acid esters (such as alkoxyboranes and aryloxyborane), and cyclic compounds (such as borazine) having B—N bonds. Boron trichloride may also be used.

An alternative to introducing a boron compound-containing gas into the container is to form the electron-emitting part with a boron-containing material, and then to heat it in nitrogen, ammonia or a nitrogen- or ammonia-containing atmosphere so as to form the BN film near the electron-emitting part. The result is also an improvement in the efficiency of electron emission from the electron-emitting part.

As explained in detail in the foregoing, the present invention is characterized in that the secondary-electron emitting material is exposed in the vicinity of the electron-emitting part and the high-potential electrode. This structure permits secondary electrons to be emitted efficiently when electrons emitted from the electron-emitting part collide with the upper surface of the substrate. Because of this mechanism, the device emits secondary electrons sufficiently at the control electrode even though the driving voltage is as low as 10 V to 30 V. Therefore, it is possible to improve the efficiency of electron emission, to decrease the wasted current flowing through the device, to eliminate heat generation, and to extend the life of the device.

The device may have an auxiliary electrode for secondary-electron emission in the vicinity of the high-potential electrode. In addition, when a BN film is formed around the electron-emitting part, it is possible to improve the efficiency of electron emission from the electron emitting part itself.

Numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A field emission element comprising: a substrate;

a first electrode on said substrate;

a second electrode on said substrate separated from said first electrode;

a third electrode on said substrate separated from said second electrode, said second electrode being located between said first electrode and said third electrode; and a first secondary-electron emitting material on a surface of said second electrode.

2. A field emission element according to claim 1, wherein said first electrode and said second electrode engage each other.

3. A field emission element according to claim 1, wherein said first secondary-electron emitting material coats said second electrode smoothly.

4. A field emission element according to claim 1, wherein said first secondary-electron emitting material comprises particles.

5. A field emission element according to claim 1, wherein an accelerating energy of an electron formed by an electric potential difference between said first electrode and said second electrode is between $E_{PE(I)}$ and $E_{PE(II)}$, where $E_{PE(I)}$ represents an energy of incident electrons for which a multiplication factor δ of secondary electrons rises to unity and $E_{PE(II)}$ represents the energy of incident electrons for which δ falls to unity.

6. A field emission element according to claim 1, wherein an accelerating energy of an electron formed by an electric potential difference between said first electrode and said second electrode substantially equals to $E_{PE(m)}$, where $E_{PE(m)}$ represents an energy of incident electrons at which a multiplication factor δ of secondary electrons is a maximum.

7. A field emission element according to claim 1, further comprising:

a second secondary-electron emitting material disposed on said third electrode.

8. A field emission element according to claim 7, wherein said second secondary-electron emitting material coats said third electrode smoothly.

9. A field emission element according to claim 7, wherein said second secondary-electron emitting material comprises particles.

10. A field emission element according to claim 7, wherein a maximum of a secondary electron increasing ratio of said first secondary-electron emitting material is smaller than a maximum of a secondary electron increasing ratio of said second secondary-electron emitting material.

11. A field emission element according to claim 7, wherein an $E_{PE(I)}$ of said first secondary-electron emitting material is smaller than an $E_{PE(I)}$ of said second secondary-electron emitting material, where $E_{PE(I)}$ represents an energy of incident electrons for which a multiplication factor δ of secondary electrons rises to unity.

12. A field emission element according to claim 7, wherein said first secondary-electron emitting material and said second secondary-electron emitting material are selected from the group of LiF, CaF, AlN, BN, B, Bi, Ga, BaO, and MgO.

13. A field emission element according to claim 7, wherein an accelerating energy of an electron formed by an electric potential difference between said first electrode and said second electrode is between $E_{PE(I)}$ and $E_{PE(II)}$, where $E_{PE(I)}$ represents an energy of incident electrons for which a multiplication factor δ of secondary electrons rises to unity and $E_{PE(II)}$ represents the energy of incident electrons for which δ falls to unity.

14. A field emission element according to claim 7, wherein an accelerating energy of an electron formed by an electric potential difference between said first electrode and said second electrode substantially equals to $E_{PE(m)}$, where $E_{PE(m)}$ represents an energy of incident electrons at which a multiplication factor δ of secondary electrons is a maximum.

15. A field emission element according to claim 1, further comprising:

an insulator between said first electrode and said second electrode.

16. A field emission element according to claim 1, further comprising:

an insulator between said second electrode and said third electrode.

17. A field emission element according to claim 16, further comprising:

a third secondary-electron emitting material on said insulator.

* * * * *